US012760727B2

(12) United States Patent
Kim et al.

(10) Patent No.: US 12,760,727 B2
(45) Date of Patent: Oct. 13, 2026

(54) RECIPROCATING PUMP

(71) Applicant: EBARA CORPORATION, Tokyo (JP)

(72) Inventors: Hoechun Kim, Tokyo (JP); Shuichiro Honda, Tokyo (JP); Tetsuji Kasatani, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 19/150,029

(22) PCT Filed: Jan. 25, 2023

(86) PCT No.: PCT/JP2023/002256

§ 371 (c)(1),
(2) Date: Jul. 22, 2025

(87) PCT Pub. No.: WO2024/157388

PCT Pub. Date: Aug. 2, 2024

(65) Prior Publication Data

US 2026/0028972 A1 Jan. 29, 2026

(51) Int. Cl.

| | |
|---|---|
| ***F04B 53/14*** | (2006.01) |
| ***F04B 15/08*** | (2006.01) |
| ***F04B 53/12*** | (2006.01) |

(52) U.S. Cl.

CPC ..... *F04B 53/143* (2013.01); *F04B 15/08* (2013.01); *F04B 53/12* (2013.01); *F04B 2015/081* (2013.01)

(58) Field of Classification Search

CPC ..... F04B 53/143; F04B 53/08; F04B 53/12; F04B 2015/081

See application file for complete search history.

(56) References Cited

U.S. PATENT DOCUMENTS 3,036,529 A * 5/1962 Archer ..... F04B 5/00 92/158
4,639,197 A 1/1987 Tornare et al.
(Continued)

FOREIGN PATENT DOCUMENTS

JP 2004-162646 A 6/2004
JP 2020-084808 A 6/2020
(Continued)

OTHER PUBLICATIONS

International Search Report for PCT/JP2023/002256 dated Mar. 28, 2023.

(Continued)

*Primary Examiner* — Nathan C Zollinger
(74) *Attorney, Agent, or Firm* — Chrisman Gallo Tochtrop LLC

(57) ABSTRACT

The reciprocating pump includes a cylinder having an inflow chamber, a reset chamber, an intermediate chamber, and a pressurizing chamber therein, a piston located in the cylinder, a first seal, a second seal, and a third seal arranged in a gap between an inner surface of the cylinder and an outer surface of the piston, a suction check valve coupled to a suction port, an inlet check valve and an outlet check valve disposed in a piston passage, a discharge check valve coupled to a discharge port, and a leakage discharge check valve coupled to a leakage discharge port of the cylinder. The piston has a communication passage that provides a fluid communication between the piston passage and the intermediate chamber.

4 Claims, 6 Drawing Sheets

(56) References Cited

U.S. PATENT DOCUMENTS

| | | | | |
|---|---|---|---|---|
| 6,530,761 | B1 | 3/2003 | Chalk et al. | |
| 7,223,080 | B2 * | 5/2007 | Duron | F04B 37/08 417/901 |
| 2002/0085921 | A1 * | 7/2002 | Gram | F04B 19/06 417/528 |
| 2023/0085780 | A1 | 3/2023 | Benistand-Hector et al. | |
| 2025/0198399 | A1 * | 6/2025 | An | F04B 53/10 |

FOREIGN PATENT DOCUMENTS

| | | | |
|---|---|---|---|
| KR | 10-2022-0139074 | A | 10/2022 |
| WO | 2021/164901 | A1 | 8/2021 |

OTHER PUBLICATIONS

Supplemental European Search Report for 23 91 8354 dated Aug. 26, 2026.

* cited by examiner

RECIPROCATING PUMP

CROSS-REFERENCE TO RELATED APPLICATIONS

This application is a U.S. national stage application of the PCT International Application No. PCT/JP2023/002256 filed on Jan. 25, 2023, the contents of which is incorporated herein by reference.

TECHNICAL FIELD

The present invention relates to a reciprocating pump, such as a plunger pump or a piston pump, and more particularly to a reciprocating pump suitable for delivering liquefied gas.

BACKGROUND ART

A reciprocating pump is configured to suck a fluid into a cylinder and pressurize the fluid to expel it from the cylinder by reciprocating a piston disposed in the cylinder. Such a reciprocating pump may be used to deliver liquefied gas, such as liquid hydrogen, liquefied natural gas, liquefied ammonia, liquid nitrogen, liquefied ethylene gas, or liquefied petroleum gas.

FIG. 6 is a schematic diagram showing a cross section of a conventional reciprocating pump. As shown in FIG. 6, the reciprocating pump has a cylinder 500 and a piston 501 movably disposed within the cylinder 500. The piston 501 is coupled to an actuator (not shown). Seals 503 are disposed between an inner surface of the cylinder 500 and an outer surface of the piston 501. Check valves 514 and 515 are coupled to a suction port 510 and a discharge port 511 of the cylinder 500, respectively.

As the actuator reciprocates the piston 501 in axial directions, fluid flows into the cylinder 500 through the check valve 514 and the suction port 510, is pressurized by the piston 501, and is expelled from the cylinder 500 through the discharge port 511 and the check valve 515.

CITATION LIST

Patent Literature

Patent document 1: U.S. Pat. No. 6,530,761

SUMMARY OF INVENTION

Technical Problem

However, the conventional reciprocating pump shown in FIG. 6 has the following problems.

A first problem is that a part of the fluid pressurized by the piston 501 leaks out of the cylinder 500 through the seals 503. Particularly in the reciprocating pump for liquefied gas, in order to reduce evaporation of the liquefied gas caused by a sliding heat of the seals 503, a tiny leakage path exists between seals 503 and the cylinder 500, which allows a certain amount of fluid leakage. For this reason, as the piston 501 reciprocates, a part of the fluid pressurized by the piston 501 leaks out of the cylinder 500 through the seals 503.

A second problem is that when the piston 501 moves to suck in the fluid, the fluid remaining in the cylinder 500 expands, preventing a decrease in pressure within the cylinder 500 and hindering the fluid from being sucked into the cylinder 500. In particular, the liquefied gas is likely to expand and vaporize as the piston 501 moves. Such expansion of the fluid in the cylinder 500 prevents a decrease in pressure within the cylinder 500 and reduces an amount of the fluid sucked into the cylinder 500. As a result, efficiency of the reciprocating pump is lowered.

Therefore, the present invention provides a reciprocating pump that can improve efficiency by reducing an amount of fluid leaking out of a cylinder and ensuring an amount of fluid flowing into the cylinder.

Solution to Problem

In an embodiment, there is provided a reciprocating pump for delivering liquefied gas, comprising: a cylinder having an inflow chamber, a reset chamber, an intermediate chamber, and a pressurizing chamber therein; a piston located in the cylinder; a first seal, a second seal, and a third seal arranged in a gap between an inner surface of the cylinder and an outer surface of the piston; a suction check valve coupled to a suction port of the cylinder; an inlet check valve and an outlet check valve disposed in a piston passage extending through the piston; a discharge check valve coupled to a discharge port of the cylinder; and a leakage discharge check valve coupled to a leakage discharge port of the cylinder, wherein the leakage discharge port communicates with the reset chamber, the inflow chamber and the reset chamber are partitioned by the first seal, the reset chamber and the intermediate chamber are partitioned by the second seal, the intermediate chamber and the pressurizing chamber are partitioned by the third seal, and the piston has a communication passage that provides a fluid communication between the piston passage and the intermediate chamber.

In an embodiment, the reciprocating pump further comprises a shaft seal device configured to seal a gap between a piston rod coupled to the piston and the cylinder.

In an embodiment, a diameter of the inflow chamber is larger than a diameter of the pressurizing chamber.

In an embodiment, the inflow chamber, the reset chamber, the intermediate chamber, and the pressurizing chamber are arranged in an order of the inflow chamber, the reset chamber, the intermediate chamber, and the pressurizing chamber along a longitudinal direction of the cylinder.

Advantageous Effects of Invention

According to the present invention, the fluid that has leaked from the pressurizing chamber through the third seal into the intermediate chamber is mixed with the fluid in the piston passage through the communication passage and is sent to the pressurizing chamber again as the piston moves. Therefore, an amount of fluid leaking outside the cylinder is reduced. Although a part of the fluid in the intermediate chamber leaks through the second seal to the reset chamber, the fluid in the reset chamber is discharged outside the cylinder through the leakage discharge port and the leakage discharge check valve. Therefore, the fluid in the reset chamber does not flow into the inflow chamber, and the pressure in the inflow chamber is maintained low. As a result, when the piston performs a suction operation, an intended amount of fluid can be sucked into the inflow chamber. In this way, a sufficient amount of fluid is sucked, pressurized, and delivered by the reciprocating motion of the piston, so that the efficiency of the reciprocating pump can be improved. Since the amount of fluid discharged from the reset chamber to the outside of the cylinder through the leakage discharge port and the leakage discharge check valve is small, the amount of fluid delivered by the reciprocating pump is not substantially reduced.

DESCRIPTION OF EMBODIMENTS

Hereinafter, embodiments of the present invention will be described with reference to the drawings. A reciprocating pump of the embodiments described below is suitable for delivering liquefied gases, such as liquid hydrogen, liquefied natural gas, liquefied ammonia, liquid nitrogen, liquefied ethylene gas, and liquefied petroleum gas.

Figure 1:
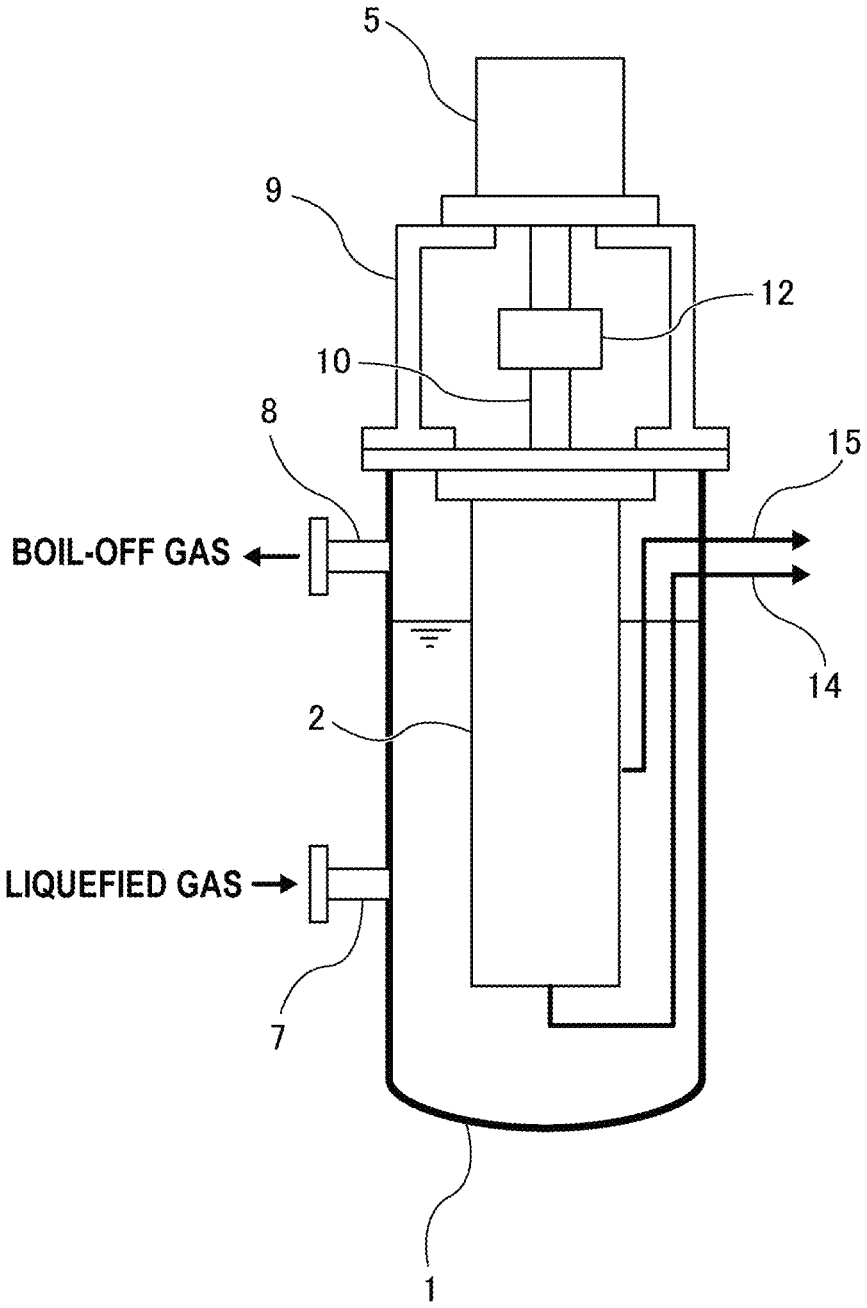
FIG. 1 is a schematic diagram showing an embodiment of a liquefied-gas delivering system including a reciprocating pump.

FIG. 1 is a schematic diagram showing an embodiment of a liquefied-gas delivering system having a reciprocating pump. As shown in FIG. 1, the liquefied-gas delivering system includes a storage tank 1 for storing liquefied gas therein, a reciprocating pump 2 disposed in the storage tank 1, and an actuator 5 configured to drive the reciprocating pump 2. The liquefied gas is sent into the storage tank 1 through a liquefied-gas inlet port 7 of the storage tank 1, and is stored in the storage tank 1.

Most of the liquefied gas in the storage tank 1 is in a liquid state. However, a small amount of heat is transferred from a surrounding atmosphere to the liquefied gas through a wall of the storage tank 1. As a result, a part of the liquefied gas is gasified to form boil-off gas (BOG). Therefore, the storage tank 1 is provided with a boil-off gas discharge port 8 for discharging the boil-off gas. The boil-off gas in the storage tank 1 is discharged from the storage tank 1 through the boil-off gas discharge port 8.

A piston rod 10 of the reciprocating pump 2 is coupled to the actuator 5 via a coupling device 12. The actuator 5 is fixed to the storage tank 1 through a bracket 9. Examples of the actuator 5 include a linear motor, a hydraulic cylinder, and a combination of a crank mechanism and an electric motor. The reciprocating pump 2 has a suction port (which is not shown in FIG. 1) for the liquefied gas which is located lower than a liquid level of the storage tank 1. When the actuator 5 drives the reciprocating pump 2, the reciprocating pump 2 sucks in the liquefied gas stored in the storage tank 1, pressurizes the liquefied gas, and discharges the liquefied gas to a liquefied-gas discharge line 14. The pressurized liquefied gas is delivered to the outside of the storage tank 1 through the liquefied-gas discharge line 14.

The liquefied-gas delivering system further includes a leakage discharge line 15 coupled to the reciprocating pump 2. This leakage discharge line 15 is provided to discharge, from the reciprocating pump 2, a small amount of fluid that has leaked from a pressurizing chamber of the reciprocating pump 2, as described below.

Figure 2:
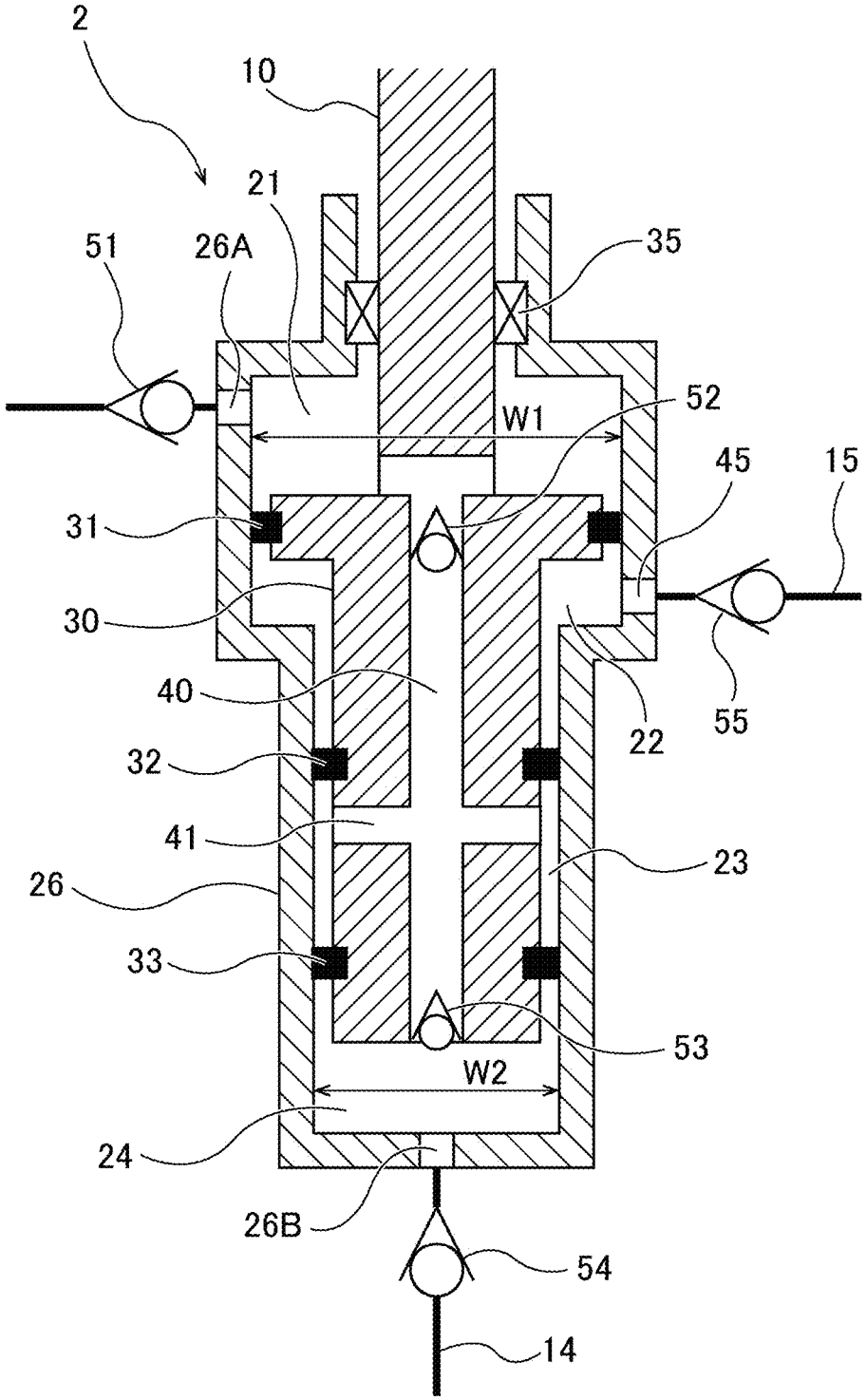
FIG. 2 is a cross-sectional view showing an embodiment of the reciprocating pump.

FIG. 2 is a cross-sectional view showing an embodiment of the reciprocating pump 2. The liquefied gas in the reciprocating pump 2 is in a liquid state, a gasified state, or a supercritical state depending on pressure and/or temperature of the liquefied gas. Therefore, in the following description, the liquefied gas is referred to as "fluid", and the state of the "fluid" includes a liquid state, a gaseous state, and a supercritical state.

The reciprocating pump 2 is a positive displacement pump for delivering the liquefied gas. As shown in FIG. 2, the reciprocating pump 2 includes a cylinder 26 having an inflow chamber 21, a reset chamber 22, an intermediate chamber 23, and a pressurizing chamber 24 therein, a piston 30 arranged in the cylinder 26, and a first seal 31, a second seal 32, and a third seal 33 arranged in a gap between an inner surface of the cylinder 26 and an outer surface of the piston 30. The piston 30 is coupled to a piston rod 10, which is coupled to the actuator 5 shown in FIG. 1. The piston 30 is driven by the actuator 5 to reciprocate within the cylinder 26.

The first seal 31, the second seal 32, and the third seal 33 are held by the piston 30 and reciprocate together with the piston 30. Therefore, the seals 31, 32, and 33 are movable seals. Structures of the seals 31, 32, and 33 are not particularly limited as long as the seals 31, 32, and 33 are configured to seal the gap between the inner surface of the cylinder 26 and the outer surface of the piston 30, while for example, the first seal 31, the second seal 32, and the third seal 33 may be seal rings made of resin or metal.

The reciprocating pump 2 further includes a shaft seal device 35 configured to seal a gap between the piston rod 10 and the cylinder 26. The shaft seal device 35 is a static seal device held by the cylinder 26. The shaft seal device 35 faces the inflow chamber 21 formed in the cylinder 26 and has a function of separating the inflow chamber 21 from the outside of the cylinder 26 (i.e., an atmosphere above the storage tank 1 shown in FIG. 1). An example of the shaft seal device 35 is a gland packing. In one embodiment, the shaft seal device 35 may be a movable seal that is held by the piston rod 10 and can move together with the piston rod 10.

The inflow chamber 21, the reset chamber 22, the intermediate chamber 23, and the pressurizing chamber 24 are formed between the piston 30 and the cylinder 26. The inflow chamber 21, the reset chamber 22, the intermediate chamber 23, and the pressurizing chamber 24 are arranged in the order of the inflow chamber 21, the reset chamber 22, the intermediate chamber 23, and the pressurizing chamber 24 along a longitudinal direction of the cylinder 26. Specifically, the inflow chamber 21 is adjacent to the reset chamber 22, the reset chamber 22 is adjacent to the intermediate chamber 23, and the intermediate chamber 23 is adjacent to the pressurizing chamber 24. The inflow chamber 21 and the reset chamber 22 are partitioned by the first seal 31, the reset chamber 22 and the intermediate chamber 23 are partitioned by the second seal 32, and the intermediate chamber 23 and the pressurizing chamber 24 are partitioned by the third seal 33. The reset chamber 22 is located between the first seal 31 and the second seal 32, and the intermediate chamber 23 is located between the second seal 32 and the third seal 33.

The cylinder 26 has a suction port 26A for the fluid and a discharge port 26B for the fluid. The suction port 26A is in communication with the inflow chamber 21, and the discharge port 26B is in communication with the pressurizing chamber 24. The piston 30 has a piston passage 40 extending through an interior of the piston 30. The piston passage 40 extends from the inflow chamber 21 to the pressurizing chamber 24. Specifically, an inlet of the piston passage 40 opens in the inflow chamber 21, and an outlet of the piston passage 40 opens in the pressurizing chamber 24. The piston 30 further has a communication passage 41 that provides a fluid communication between the piston passage 40 and the intermediate chamber 23. One end of the communication passage 41 is coupled to the piston passage 40, and the other end of the communication passage 41 is coupled to the intermediate chamber 23.

The cylinder 26 has a leakage discharge port 45 communicating with the reset chamber 22. The reciprocating pump 2 includes a suction check valve 51 coupled to the suction port 26A of the cylinder 26, an inlet check valve 52 and an outlet check valve 53 arranged in the piston passage 40, a discharge check valve 54 coupled to the discharge port 26B of the cylinder 26, and a leakage discharge check valve 55 coupled to the leakage discharge port 45 of the cylinder 26.

An inlet of the suction check valve 51 is located lower than the liquid level in the storage tank 1 shown in FIG. 1. The suction check valve 51 is configured to allow the fluid (liquefied gas) in the storage tank 1 to flow into the inflow chamber 21 in the cylinder 26, and not to allow the fluid to flow in an opposite direction.

The inlet check valve 52 is disposed at an inlet side of the piston passage 40, and the outlet check valve 53 is disposed at an outlet side of the piston passage 40. The inlet check valve 52 and the outlet check valve 53 are configured to allow the fluid to flow from the inflow chamber 21 to the pressurizing chamber 24, and not to allow the fluid to flow in an opposite direction. The inlet check valve 52 and the outlet check valve 53 are fixed to the piston 30, and reciprocate together with the piston 30. The communication passage 41 communicates with the piston passage 40 at a position between the inlet check valve 52 and the outlet check valve 53.

The discharge check valve 54 is configured to allow the fluid to flow out of the pressurizing chamber 24 and not to allow the fluid to flow in an opposite direction. An outlet of the discharge check valve 54 is coupled to the liquefied-gas discharge line 14.

The leakage discharge check valve 55 is configured to allow the fluid to flow out of the reset chamber 22 and not to allow the fluid to flow in an opposite direction. An outlet of the leakage discharge check valve 55 is coupled to the leakage discharge line 15.

As shown in FIG. 2, a diameter W1 of the inflow chamber 21 is larger than a diameter W2 of the pressurizing chamber 24. As can be seen from FIG. 2, since the piston rod 10 exists in the inflow chamber 21, a volume of the inflow chamber 21 is reduced by a volume of the piston rod 10. The configuration of the inflow chamber 21 having the diameter W1 larger than the diameter W2 of the pressurizing chamber 24 can make it possible to make the volume of the inflow chamber 21 the same as the volume of the pressurizing chamber 24, or to adjust a volume ratio of the inflow chamber 21 to the pressurizing chamber 24. In addition, a surface area of the cylinder 26 forming the pressurizing chamber 24 having the smaller diameter can be small, and as a result, a compression heat of the fluid in the pressurizing chamber 24 is less likely to be transferred to the outside of the cylinder 26.

Figure 3:
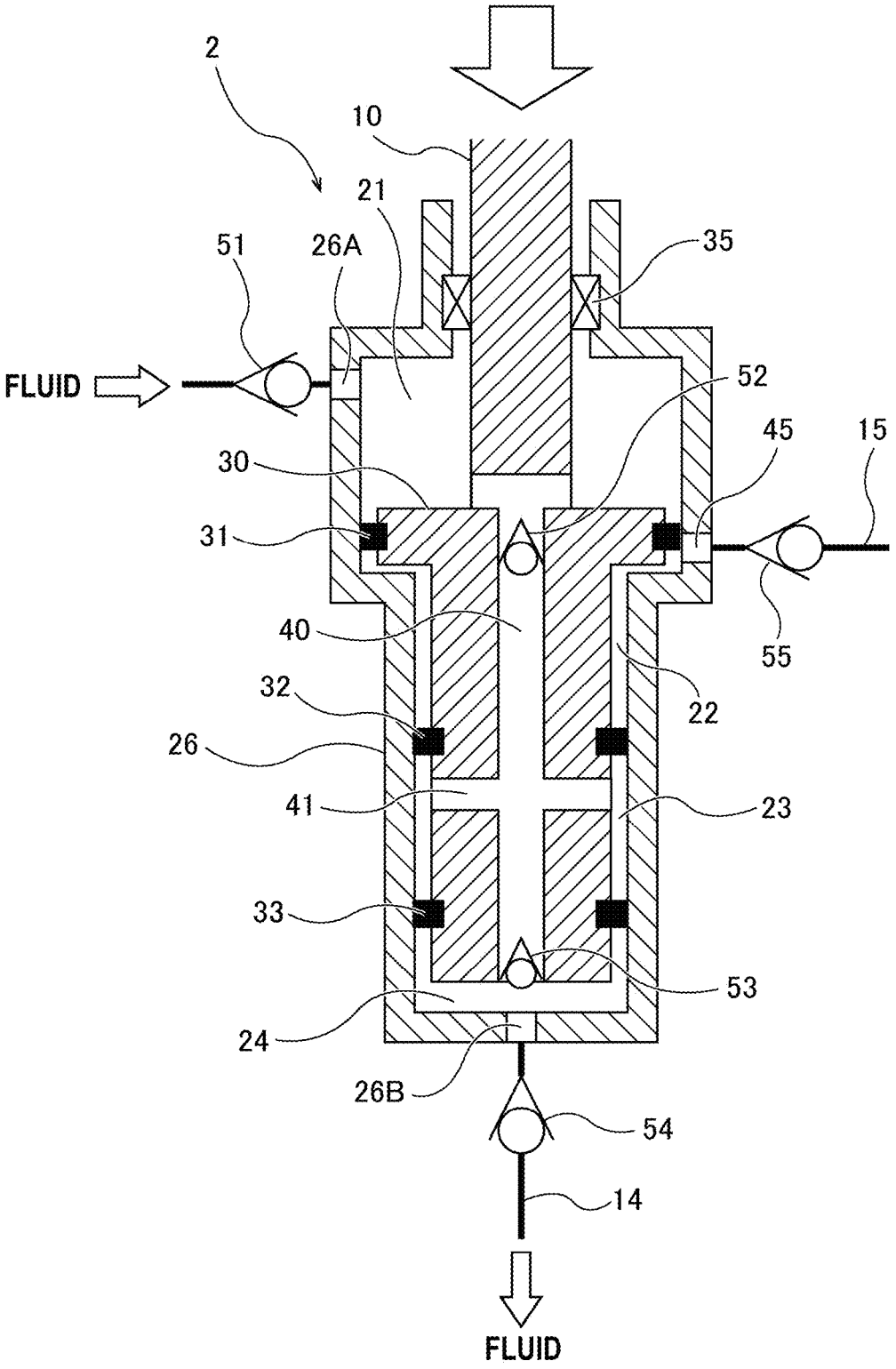
FIG. 3 is a cross-sectional view showing a state in which a piston has moved to a bottom dead center.
Figure 4:
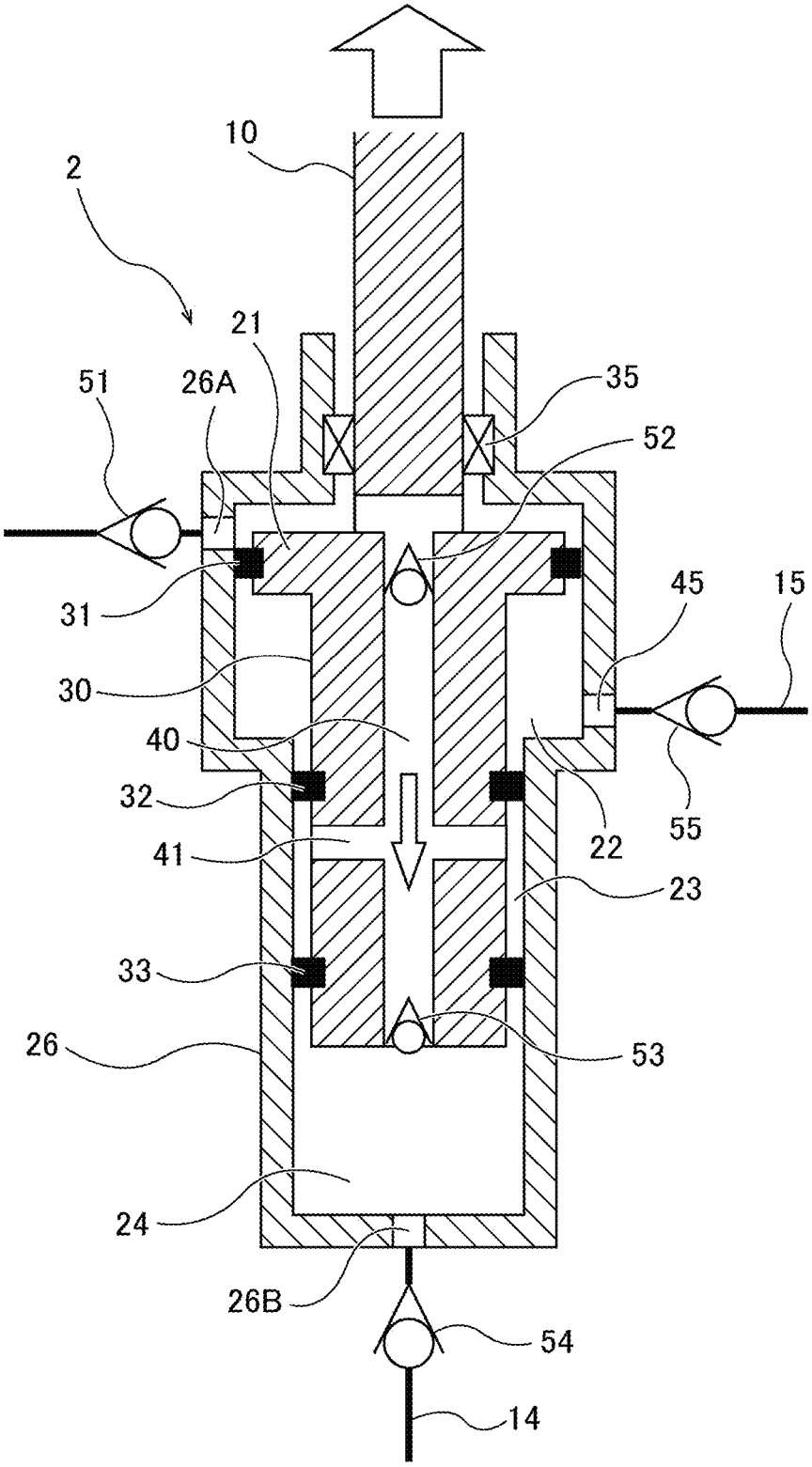
FIG. 4 is a cross-sectional view showing a state in which the piston has moved to a top dead center.

Next, the operation of the reciprocating pump 2 will be described. As shown in FIG. 3, when the piston 30 moves toward the discharge port 26B (toward the bottom dead center), the inflow chamber 21 expands, and the fluid flows into the inflow chamber 21 through the suction check valve 51 and the suction port 26A. Next, as shown in FIG. 4, when the piston 30 moves toward the suction port 26A (toward the top dead center), the fluid flows from the inflow chamber 21 into the pressurizing chamber 24 through the inlet check valve 52, the piston passage 40, and the outlet check valve 53.

Furthermore, as shown in FIG. 3, when the piston 30 moves toward the discharge port 26B, the fluid in the pressurizing chamber 24 is pressurized and discharged from the pressurizing chamber 24 through the discharge port 26B and the discharge check valve 54. At the same time, the inflow chamber 21 is expanded, and the fluid flows into the inflow chamber 21 through the suction check valve 51 and the suction port 26A. The pressurized fluid flows through the liquefied-gas discharge line 14 and is transferred to the outside of the storage tank 1 shown in FIG. 1. In this way, when the piston 30 moves in one direction, the fluid is sucked into the inflow chamber 21 and the fluid in the pressurizing chamber 24 is pressurized. When the piston 30 moves in the opposite direction, the fluid moves from the inflow chamber 21 to the pressurizing chamber 24.

In order to prevent evaporation of the fluid due to sliding heat of the first seal 31, the second seal 32, and the third seal 33, there are slight leakage paths between the seals 31, 32, and 33 and the cylinder 26, allowing a certain amount of fluid leakage. Therefore, when the piston 30 moves as shown in FIG. 3, a part of the fluid leaks from the pressurizing chamber 24 through the third seal 33 into the intermediate chamber 23. Similarly, when the piston 30 moves as shown in FIG. 4, a part of the fluid in the inflow chamber 21 leaks into the reset chamber 22 through the first seal 31.

The fluid that has leaked from the pressurizing chamber 24 to the intermediate chamber 23 through the third seal 33 is a high-enthalpy fluid. This high-enthalpy fluid is mixed with a relatively large amount of low-enthalpy fluid present in the intermediate chamber 23 to become a low-enthalpy fluid. Furthermore, the low-enthalpy fluid in the intermediate chamber 23 is sent to the pressurizing chamber 24 through the communication passage 41 and the piston passage 40. In this way, the fluid that has leaked from the pressurizing chamber 24 to the intermediate chamber 23 through the third seal 33 flows back to the pressurizing chamber 24 through the communication passage 41 and the piston passage 40, so that the amount of fluid leaking outside the cylinder 26 is reduced.

Although a part of the low enthalpy fluid in the intermediate chamber 23 leaks through the second seal 32 into the reset chamber 22, the fluid in the reset chamber 22 is discharged to the outside of the cylinder 26 through the leakage discharge port 45 and the leakage discharge check valve 55. Therefore, the fluid in the reset chamber 22 does not flow into the inflow chamber 21, so that the pressure in the inflow chamber 21 can be maintained low. As a result, when the piston 30 performs the suction operation, an intended amount of fluid can be sucked into the inflow chamber 21. In this way, a sufficient amount of fluid is sucked, pressurized, and delivered by the reciprocating action of the piston 30, and the efficiency of the reciprocating pump 2 is improved. Since the amount of fluid discharged from the reset chamber 22 to the outside of the cylinder 26 through the leakage discharge port 45 and the leakage discharge check valve 55 is small, the amount of fluid delivered by the reciprocating pump 2 is not substantially reduced.

As shown in FIG. 1, the leakage discharge line 15 extends to the outside of the storage tank 1 and may be open to the atmosphere or coupled to a gas treatment device (not shown). Examples of the gas treatment device include a gas incineration device (flaring device), a chemical gas treatment device, a gas adsorption device, etc. In one embodiment, the outlet of the leakage discharge line 15 may be located in the storage tank 1 shown in FIG. 1. In this case, the fluid that has flowed through the leakage discharge line 15 is returned to the storage tank 1.

Figure 5:
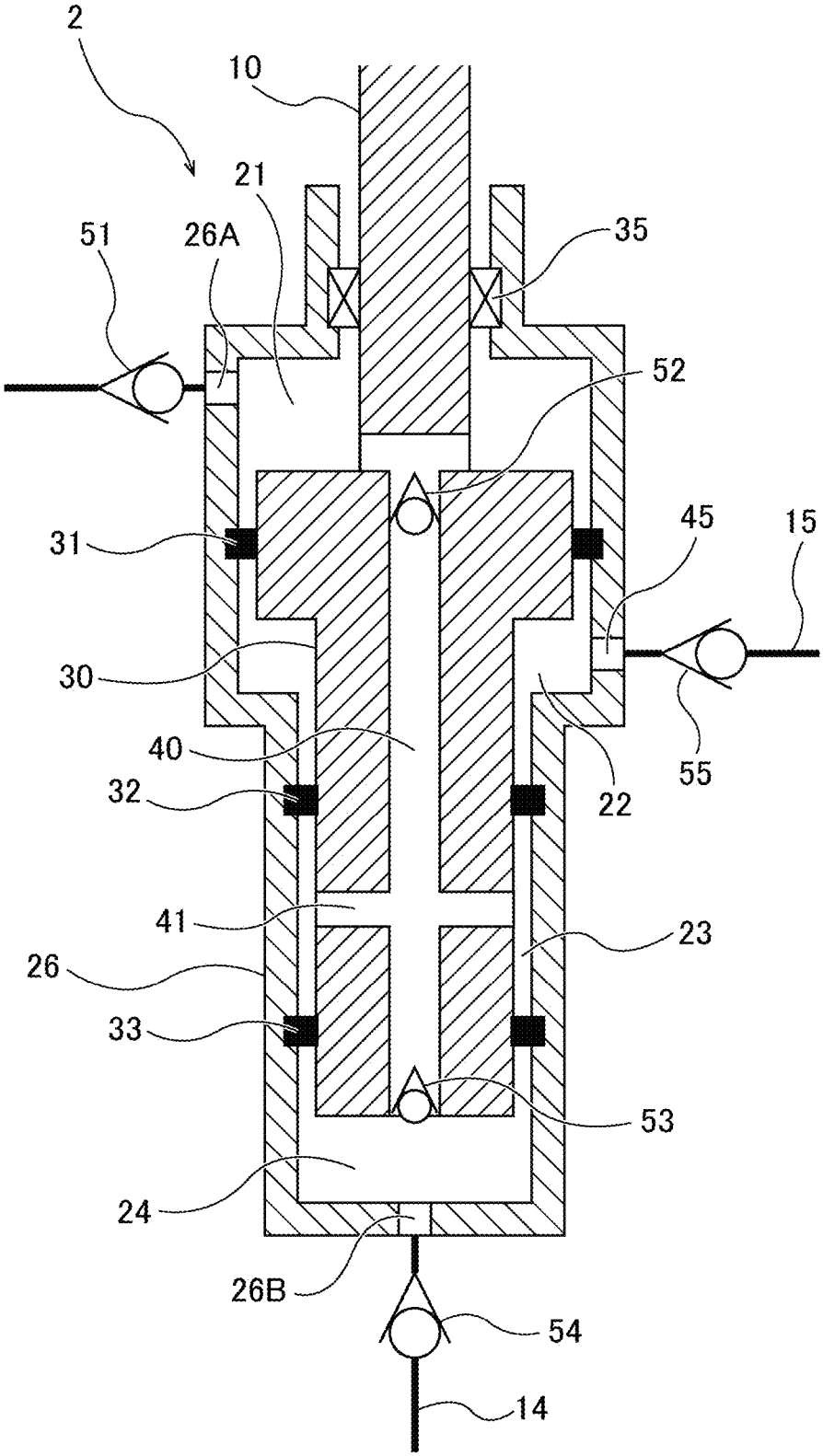
FIG. 5 is a cross-sectional view showing another embodiment of the reciprocating pump.
Figure 6:
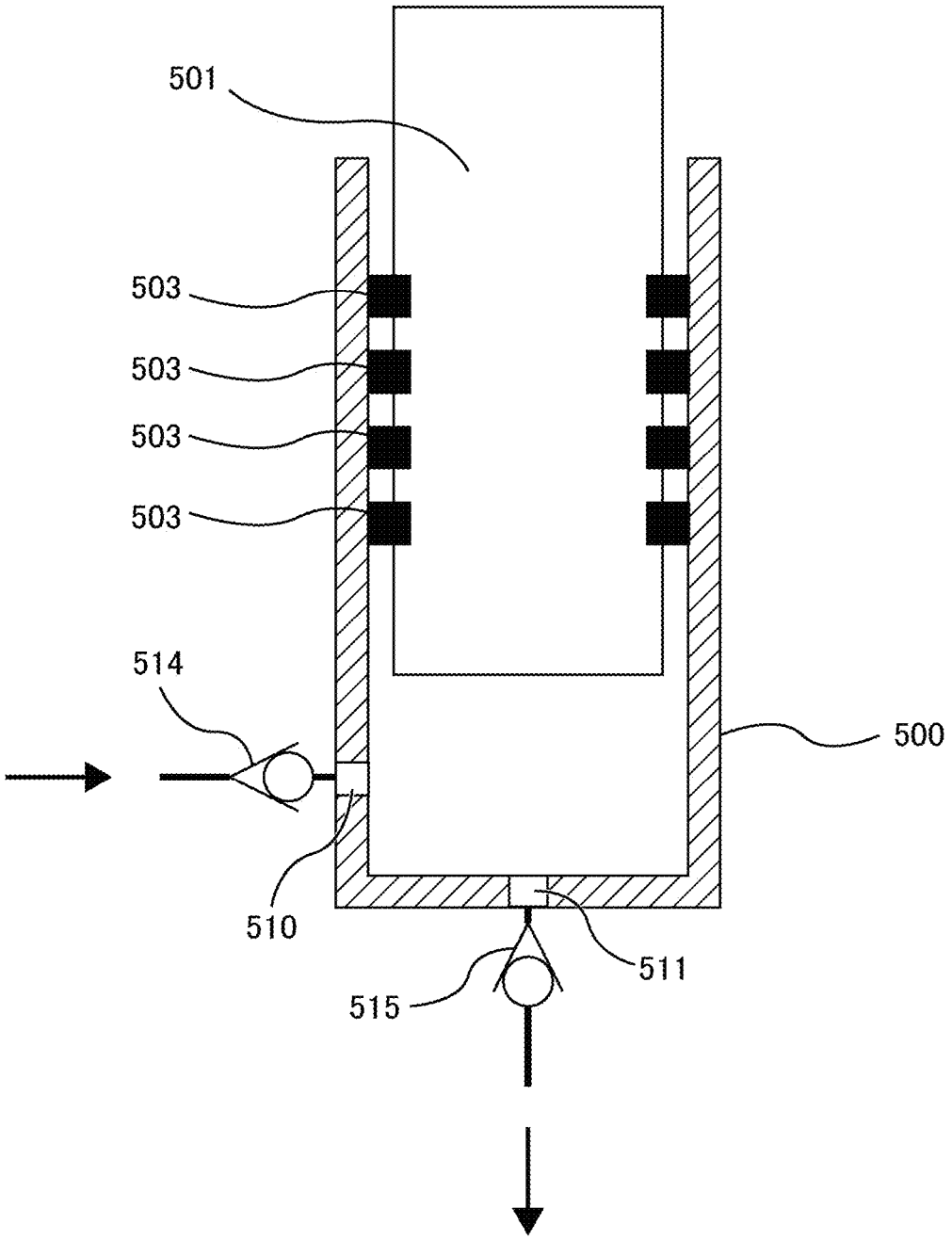
FIG. 6 is a schematic diagram showing a cross-section of a conventional reciprocating pump.

FIG. 5 is a cross-sectional view showing another embodiment of the reciprocating pump 2. Configuration and operation of this embodiment, which will not be particularly described, are the same as those of the embodiments described with reference to FIGS. 1 to 4, and duplicated descriptions thereof will be omitted.

As shown in FIG. 5, the first seal 31, the second seal 32, and the third seal 33 are stationary seals fixed to the inner surface of the cylinder 26. Therefore, these seals do not move with the reciprocating movement of the piston 30. In the embodiment shown in FIG. 5, the amount of fluid leaking outside the cylinder 26 is reduced and the efficiency of the reciprocating pump 2 can be improved as well as the embodiments described above.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a reciprocating pump, such as a plunger pump or a piston pump, and is particularly applicable to a reciprocating pump suitable for delivering liquefied gas.

REFERENCE SIGNS LIST

1 storage tank
2 reciprocating pump
5 actuator
7 liquefied-gas inlet port
8 boil-off gas discharge port
9 bracket
10 piston rod
12 coupling device
14 liquefied-gas discharge line
15 leakage discharge line
21 inflow chamber
22 reset chamber
23 intermediate chamber
24 pressurizing chamber
26 cylinder
26A suction port
26B discharge port
30 piston
31 first seal
32 second seal
33 third seal
35 shaft seal device
40 piston passage
41 communication passage
45 leakage discharge port
51 suction check valve
52 inlet check valve
53 outlet check valve
54 discharge check valve
55 leakage discharge check valve

What is claimed is:

1. A reciprocating pump for delivering liquefied gas, comprising:

a cylinder having an inflow chamber, a reset chamber, an intermediate chamber, and a pressurizing chamber therein;

a piston located in the cylinder;

a first seal, a second seal, and a third seal arranged in a gap between an inner surface of the cylinder and an outer surface of the piston;

a suction check valve coupled to a suction port of the cylinder;

an inlet check valve and an outlet check valve disposed in a piston passage extending through the piston;

a discharge check valve coupled to a discharge port of the cylinder; and a leakage discharge check valve coupled to a leakage discharge port of the cylinder, wherein the leakage discharge port communicates with the reset chamber, the inflow chamber and the reset chamber are partitioned by the first seal, the reset chamber and the intermediate chamber are partitioned by the second seal, the intermediate chamber and the pressurizing chamber are partitioned by the third seal, and the piston has a communication passage that provides a fluid communication between the piston passage and the intermediate chamber.

2. The reciprocating pump according to claim 1, further comprising a shaft seal device configured to seal a gap between a piston rod coupled to the piston and the cylinder.

3. The reciprocating pump according to claim 1, wherein a diameter of the inflow chamber is larger than a diameter of the pressurizing chamber.

4. The reciprocating pump according to claim 1, wherein the inflow chamber, the reset chamber, the intermediate chamber, and the pressurizing chamber are arranged in an order of the inflow chamber, the reset chamber, the intermediate chamber, and the pressurizing chamber along a longitudinal direction of the cylinder.

* * * * *